US006644214B1

(12) United States Patent
Schorr

(10) Patent No.: US 6,644,214 B1
(45) Date of Patent: Nov. 11, 2003

(54) CONSTANT CONTACT SIDE BEARING

(75) Inventor: Ralph H. Schorr, Granite City, IL (US)

(73) Assignee: ASF-Keystone, Inc., Granite City, IL (US)

( * ) Notice: Subject to any disclaimer, the term of this patent is extended or adjusted under 35 U.S.C. 154(b) by 0 days.

(21) Appl. No.: 10/246,325

(22) Filed: Sep. 18, 2002

(51) Int. Cl.[7] ..... B61F 5/00

(52) U.S. Cl. ..... 105/199.3; 105/453; 384/423; 188/307

(58) Field of Search ..... 105/199.3, 199.1, 105/4.1, 453; 384/423, 459, 469; 188/307

(56) References Cited

U.S. PATENT DOCUMENTS

| | | | | |
|---|---|---|---|---|
| 2,327,954 A | * | 8/1943 | Barrows et al. | 384/423 |
| 3,748,001 A | | 7/1973 | Neumann et al. | |
| 3,762,338 A | * | 10/1973 | Dwyer, Jr. | 105/199.3 |
| 3,762,339 A | | 10/1973 | Dwyer | |
| 3,897,737 A | | 8/1975 | Davis | |
| 3,910,655 A | * | 10/1975 | Willison et al. | 384/423 |
| 3,913,495 A | | 10/1975 | Pelabon | |
| 3,941,061 A | | 3/1976 | Schindehutte et al. | |
| 3,981,548 A | | 9/1976 | MacDonnell et al. | |
| 4,090,750 A | | 5/1978 | Wiebe | |
| 4,130,066 A | | 12/1978 | Mulcahy | |
| 4,434,720 A | | 3/1984 | Mulcahy et al. | |
| 4,712,487 A | | 12/1987 | Carlson | |
| 4,793,720 A | | 12/1988 | Merker, Jr. | |
| 5,036,774 A | | 8/1991 | Curtis et al. | |
| 5,086,707 A | | 2/1992 | Spencer et al. | |
| 5,806,435 A | * | 9/1998 | Pitchford | 105/199.3 |
| 6,148,734 A | | 11/2000 | Gwinn | |

FOREIGN PATENT DOCUMENTS

| | | | | |
|---|---|---|---|---|
| EP | 1186503 A1 | * | 3/2002 | |
| EP | 1186503 A1 | * | 3/2002 | B61F/5/14 |

OTHER PUBLICATIONS

Installation Instructions For Stucki (R) 656–CR Resilient Side Bearings On 50– and 7–Ton Frieght Cars, 1990, A. Stucki Co.

* cited by examiner

*Primary Examiner*—S. Joseph Morano
*Assistant Examiner*—Frantz F. Jules
(74) *Attorney, Agent, or Firm*—Edward J. Brosius

(57) ABSTRACT

A side bearing provides constant contact between a truck bolster and a railway car body. The side bearing includes a base member having a central portion mounted on top of the bolster. The base member includes end portions which extend downwardly and outwardly fore and aft beyond the bolster. A top member is mounted on the base member for vertical movement relative thereto. The end portions of the top and base members define pockets. Resilient members, such as springs, are positioned in each of the pockets for urging the top member upwardly relative to the base member. A post formed on the central portion of the top member mates with a reciprocal aperture formed on the central portion of the base member.

20 Claims, 11 Drawing Sheets

CONSTANT CONTACT SIDE BEARING

BACKGROUND OF THE INVENTION

Certain aspects of an embodiment of the present invention relate generally to railway car trucks and, more particularly, to a constant contact side bearing to yieldably resist hunting motion of the truck with respect to the car body.

A railroad car typically includes a car body supported on at least one end, and usually two ends, by wheelset trucks that are confined to roll on rails. A standard railroad truck is usually configured in a three-piece arrangement consisting of a pair of laterally spaced sideframes, a bolster extending between the sideframes, and a pair of wheelsets located at opposite ends of the sideframes.

During normal operation, when the railway car is rolling along a straight section of track, the longitudinal axis of each truck bolster is perpendicular to the longitudinal axis of the car body. Each end of the car body is pivotally supported by a truck bolster so that it can rock and swivel relative thereto on a substantially vertical axis. This pivotal connection is typically made by center bearing plates and bowls transversely centered on the car body underframe and the truck bolster, respectively. Accordingly, the truck may turn or pivot on the center plate under the car body and, under certain dynamic conditions and car speeds during operation, the truck may tend to adversely oscillate in a yaw-like manner beneath the car body. This adverse oscillation is commonly referred to in the art as "hunting," and it typically occurs when the rail car is lightly loaded and operating at speeds of between 50 and 60 mph.

In order prevent mitigate and reduce hunting, railway freight cars often incorporate devices referred to as constant contact side bearings. The constant contact side bearings are positioned on the truck bolster, outwardly of the center bowl. A constant contact side bearing typically includes a base that is fastened to the top of the bolster and a cap or top that is biased upwardly from the base by a spring so as to contact bearing wear plates (or wedges) on the car body underframe. The constant contact side bearing provides a force between the car body and the truck to frictionally retard the adverse hunting conditions.

Constant contact side bearing are designed to exert a predetermined force at a specified "set-up" height. The set-up height measured by the vertical space between the top surface of the bolster and the car body side bearing wear plate (or wedge). At this height, the constant contact side bearing is designed to exert a predetermined force between the truck bolster and the car body underframe. As the cap is compressed towards the base, e.g. due to side to side movement of the car body relative to the truck, the force exerted by the spring increases.

In freight cars the set-up height is typically either 5 1/16 (5.0625) inches or 5 7/16 (5.4375) inches. As a result, constant contact side bearings are typically designed to have a set-up height which matches one of these common freight car set-up heights. Railway tank cars have a much smaller set-up height than do railway freight cars. A conventional tank freight car has a set-up height on the order of 2¾ (2.75) inches or less. As a result, conventional contact side bearings, which have set-up that exceed the set-up heights in conventional railway tank cars, cannot be used in railway tank cars. Hence, there are thousands of railway tank cars in use in the United States and elsewhere that are not equipped with constant contact side bearings. As a result, any train with a tank car must generally travel at reduced speeds to prevent hunting from occurring. Hence, there is a need for a constant contact side bearing that has a reduced height in comparison to prior constant contact side bearings and, in particular, there is a need for a constant contact side bearing that can be used with the reduced set-up height required by conventional tank cars.

BRIEF SUMMARY OF THE INVENTION

According to certain aspects of an embodiment of the present invention, a side bearing provides constant contact between a truck bolster and a railway car body. The side bearing includes a base member having a central portion mounted on top of the bolster. The base member defines pockets extending downwardly and outwardly fore and aft beyond the bolster. A top member is mounted on the base member for vertical movement relative thereto. The top member has a central portion defining a wear pad that is in constant contact with the body wear plate and end portions that overlay the pockets. The central portions of the base and top members are sized so that the side bearing has a set-up height on the order of 2¾ (2.75) inches or less, where the set-up height is measured as the distance between the truck bolster and the car body wear plate. According to one embodiment, the base and top members are sized so that the side bearing has a set-up height on the order of 2⅜ (2.375) inches. Resilient devices are positioned in each of the pockets for urging the top member upwardly relative to the base member. The resilient devices may comprise at least one metallic spring positioned in each of the pockets. According to one embodiment, the resilient means comprises a pair of coaxial springs positioned in each of the pockets. The side bearing components are preferably configured to provide up to ⅝ (0.625) inches of vertical displacement of the top member relative to the base member, although more or less vertical travel can be provided depending on the application.

According to certain other aspects of an embodiment of the present invention, a side bearing for providing a constant contact between a truck bolster and a railway car body includes a base member having a center portion mounted on top of the bolster and end portions extending downwardly and outwardly fore and aft beyond the bolster. A top member overlies and is spaced above the base member. The top member has central portion including a wear pad which engages with the body wear plate. The top member also includes end portions which extend outwardly fore and aft beyond the bolster, and which overlay the base member end portions. The end portions of the top and base members cooperate to form pockets at each end of the base and top members. Resilient devices, such as springs, are positioned in each of the pockets. The resilient devices are configured such that the side bearing provides a predetermined load between the body wear plate and the truck bolster at a predetermined set-up height, where the set-up height is measured between the body wear plate and the truck bolster. The central portion of at least one of the top and bottom members includes a feature for limiting the rotation of the top member relative to the base member. The feature may also limit the downward vertical displacement of the top member on the base member. The feature may comprise a post formed on one of the top member and the base member, where the post is configured to mate with a reciprocal aperture formed on the other member. According to one embodiment, the top member includes a downwardly extending post that mates with a reciprocal aperture formed in the central portion of the base member. The post may be tapered so as to guide the post into the aperture as the top member moves downwardly relative to the base, thereby aligning the top member with the bottom member. The post may further be configured to limit the downward vertical displacement of the top relative to the base sufficiently to prevent the end portions of the top from engaging with the end portions of the base during downward vertical displacement of the top relative to the base. The interface between the post and the aperture also defines a path for force/load transfer between the railway car body and the truck bolster when the side bearing goes solid.

Figure 1:
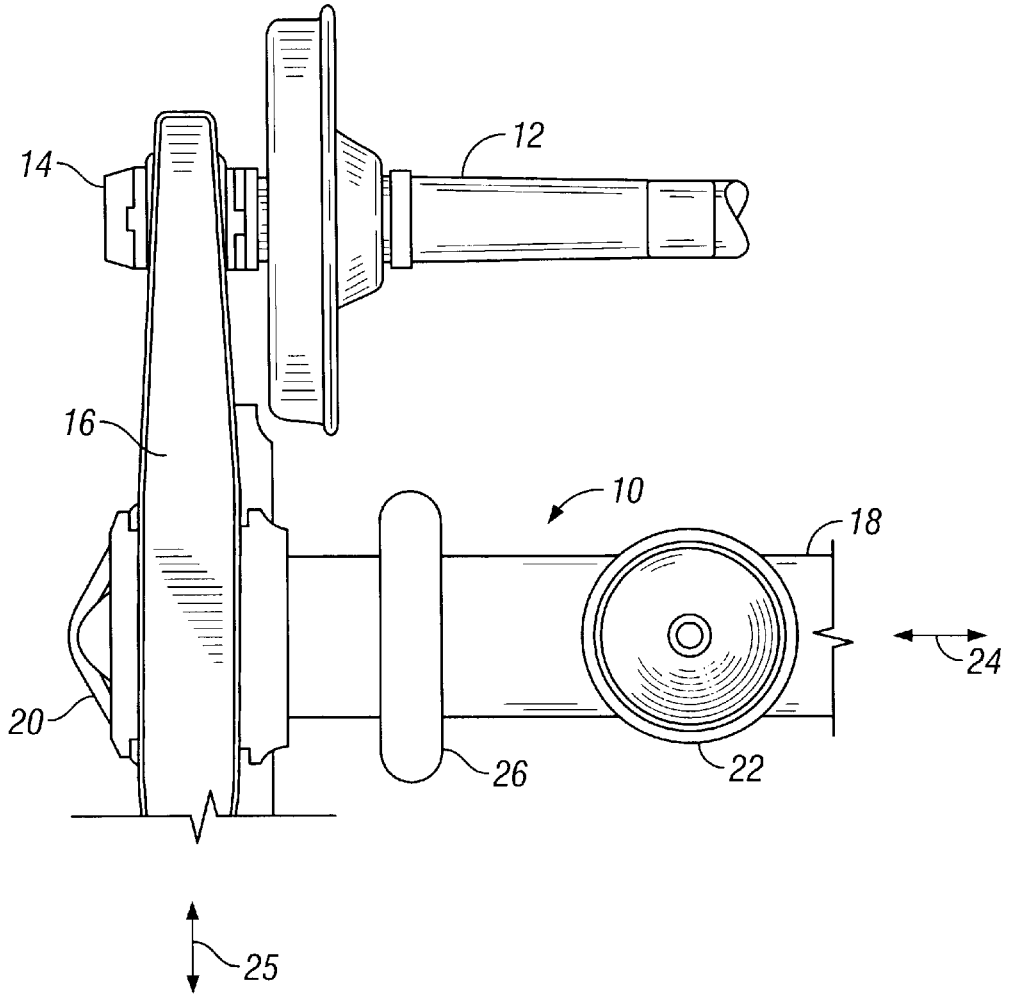
FIG. 1 is a top plan view of a railroad car truck which includes a constant contact side bearing according to certain aspects of an embodiment of the present invention

The foregoing summary, as well as the following detailed description of the preferred embodiments of the present invention, will be better understood when read in conjunction with the appended drawings. For the purpose of illustrating the preferred embodiments of the present invention, there is shown in the drawings, embodiments which are presently preferred. It should be understood, however, that the present invention is not limited to the arrangements and instrumentality shown in the attached drawings.

DETAILED DESCRIPTION OF THE INVENTION

As is shown in FIG. 1 a standard railroad car truck 10 generally comprises a pair of wheelsets, with a part of one such wheelset shown and designated 12. The wheelset 12, as shown, has one axle end 14 journaled in a bearing carried by a side frame 16. As is appreciated, the truck 10 includes a pair of such side frames, which are connected by a transversely positioned bolster partly shown and designated as element 18 in FIG. 1. An end 20 of the bolster 18 is resiliently carried in a window in the side frame 16 and supported on a spring set (not shown) in a known manner.

The bolster 18 further includes a center plate 22, which connects with the body (not shown) of the railroad car (not shown) via a body bolster. During normal operation, when the railway car is rolling along a straight section of track, the longitudinal axis 24 of each truck bolster 12 is generally perpendicular to the longitudinal axis 25 of the car body. The car body is supported by each bolster 12 so that it can rock and swivel relative thereto on a substantially vertical axis.

As will be recognized, a railroad car generally has two such trucks 10, with each truck supporting one end of the car body. A pair of the constant contact side bearings 26 according to the present invention are mounted on opposite sides of the center plate 22 of a given truck 10. Hence, a given railroad car has four of the constant contact side bearings 26.

Figure 2:
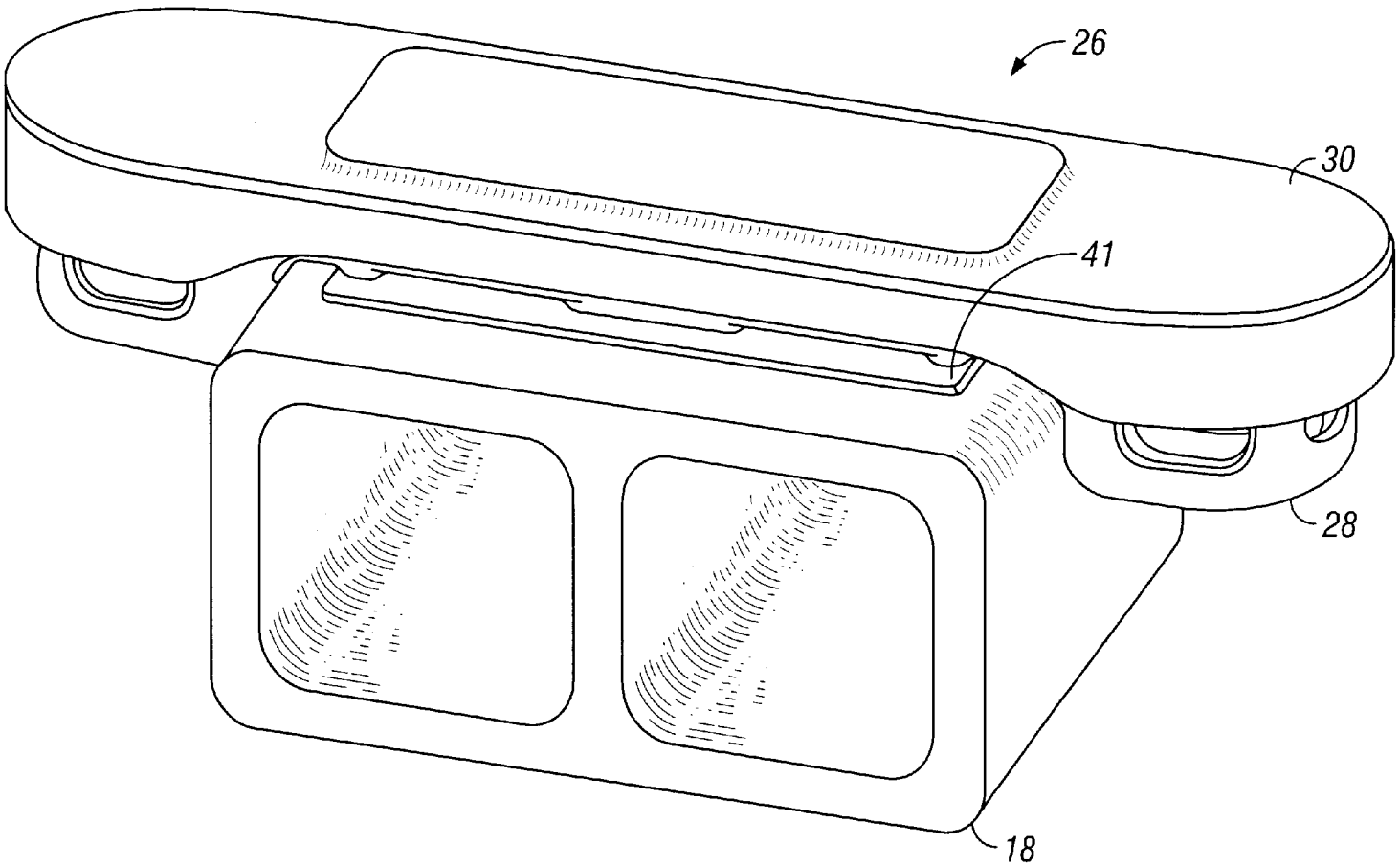
FIG. 2 is a perspective view of the constant contact side bearing of FIG. 1 in combination with a bolster of the railroad car truck.
Figure 3A:
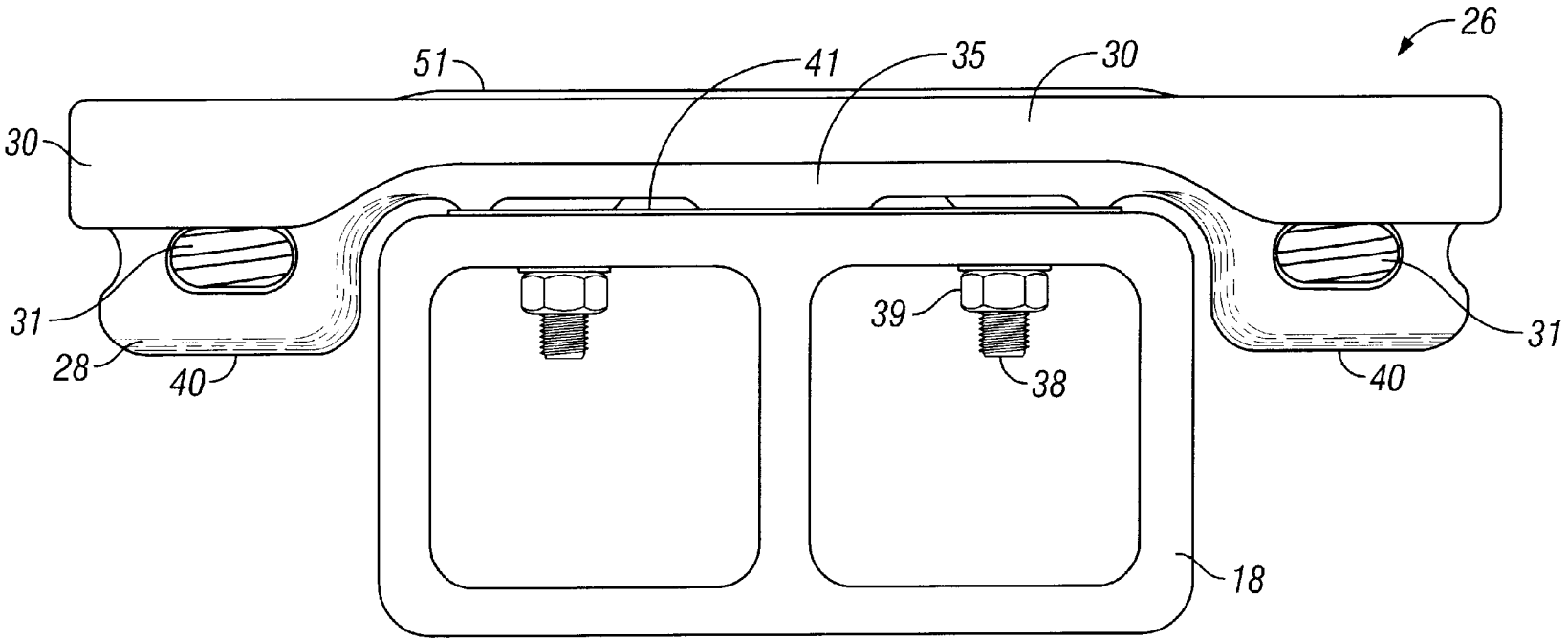
FIG. 3A is a front elevation view of the constant contact side bearing in combination with the bolster.
Figure 3B:
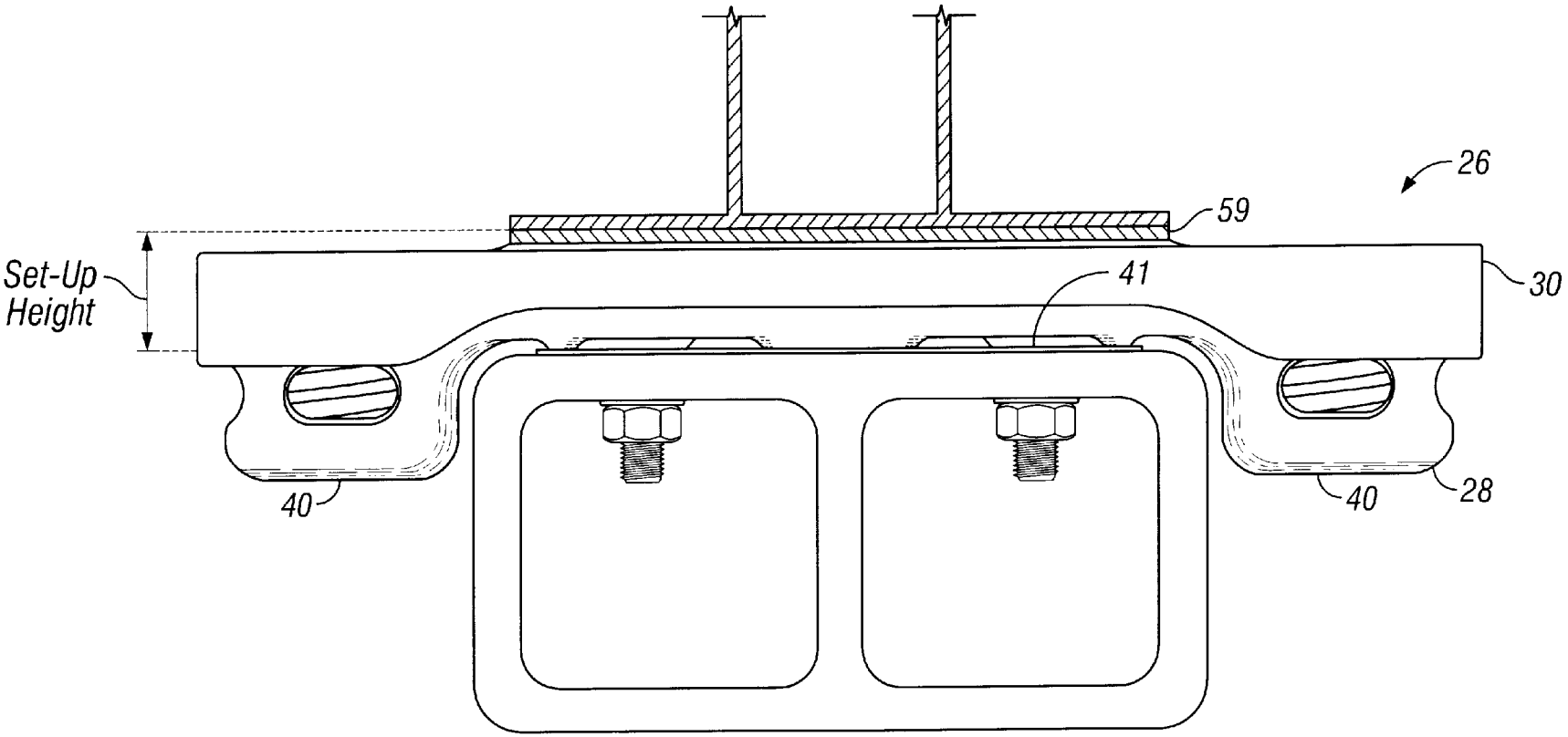
FIG. 3B is a front elevation view similar to FIG. 3A, but further showing the side bearing wear plate from the railway car body.
Figure 4:
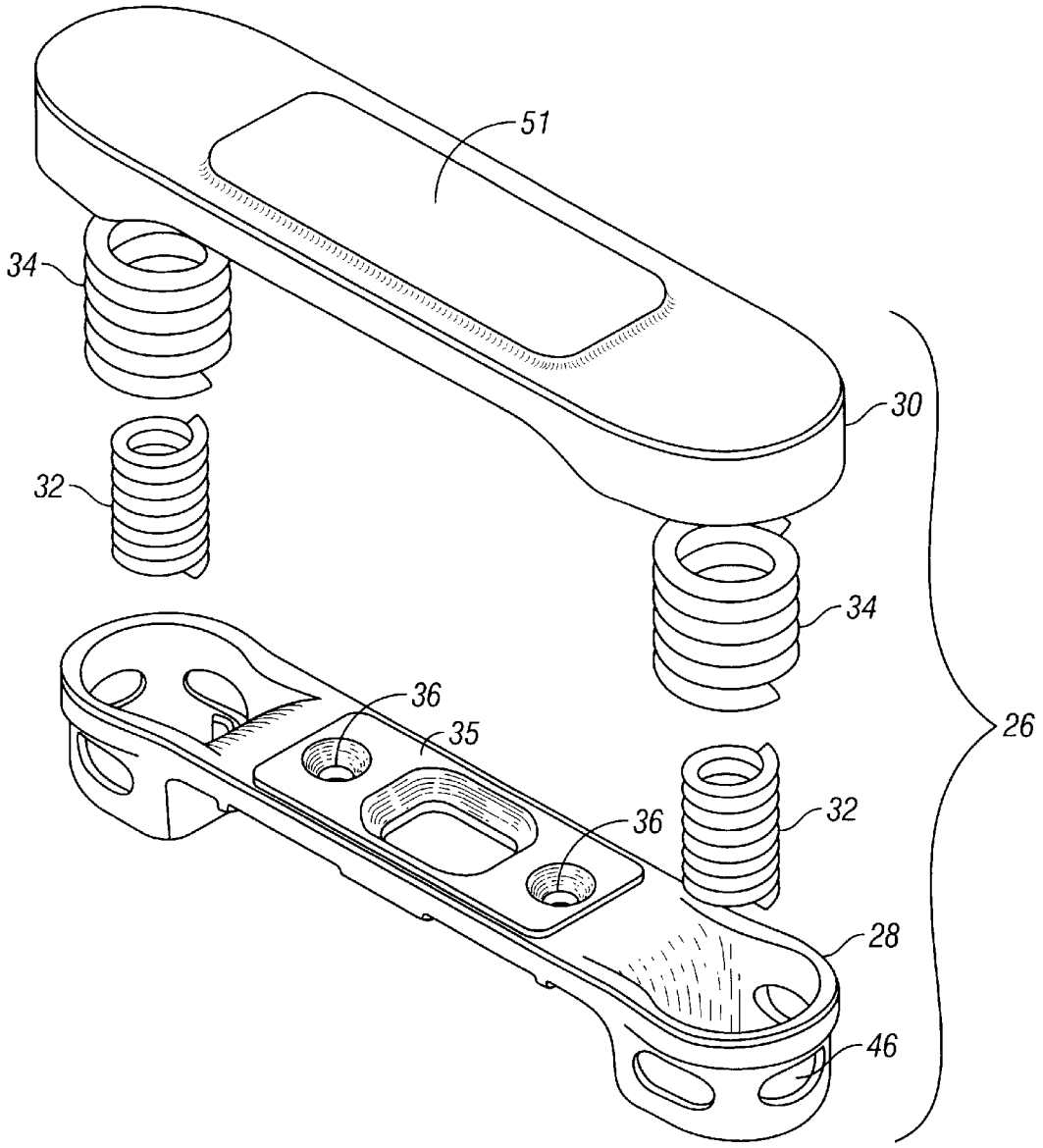
FIG. 4 is an exploded top perspective view of the constant contact side bearing.
Figure 5:
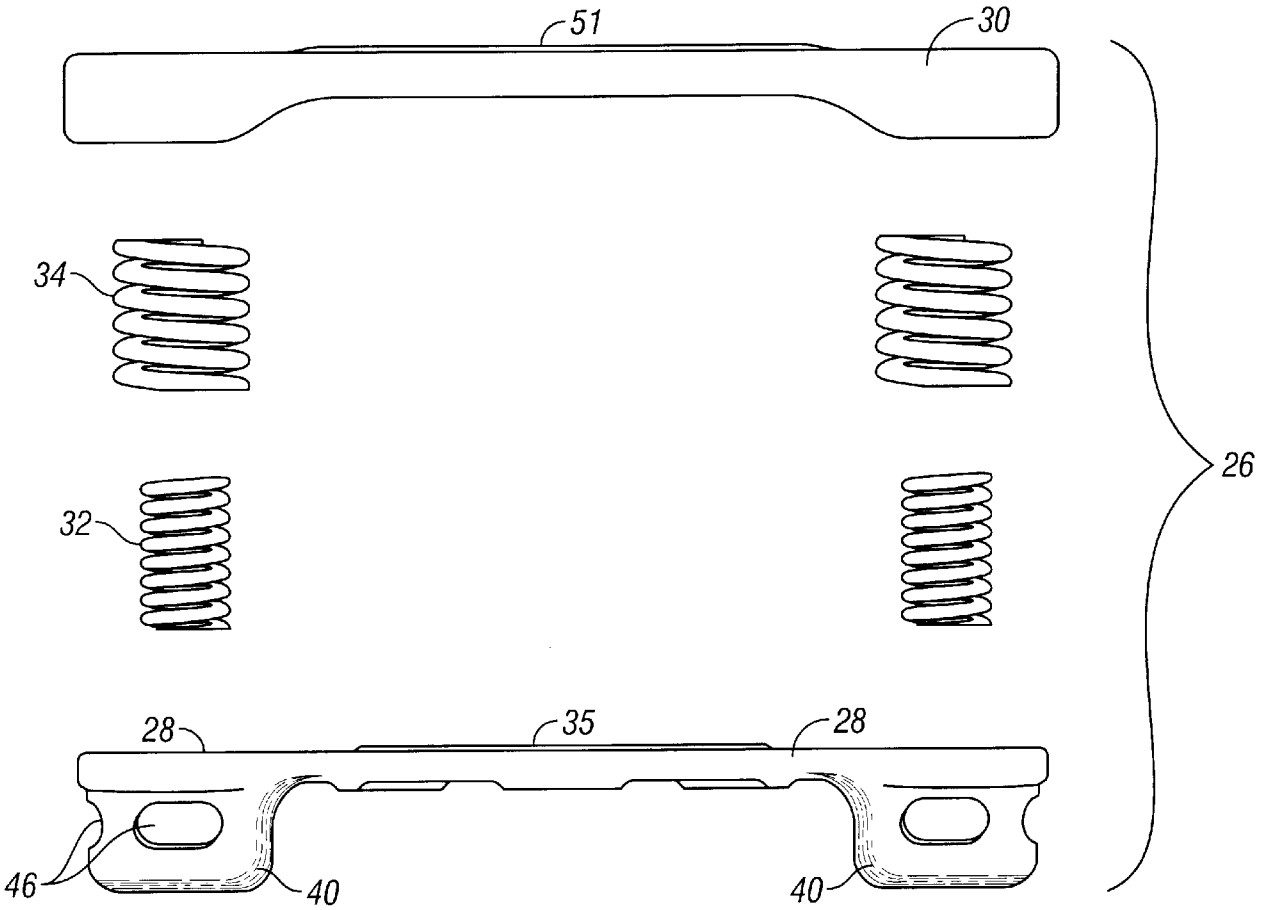
FIG. 5 is an exploded front elevation view of the constant contact side bearing.

As is shown in FIGS. 2–4, each side bearing 26 generally includes a base member 28, a top member 30, and resilient devices 31 interposed between the base and top members. In the illustrated embodiment, the resilient devices 31 comprises springs 32, 34. Alternatively, the resilient devices 31 may comprise elastomeric devices such as the elastomeric pads or blocks. The base member 28 includes a central portion 35 supported on the top surface 41, e.g., the side bearing pad, of the bolster 18. The central portion 35 of the base member 30 includes apertures 36 to facilitate connecting the side bearing 26 to the truck bolster 18 via fasteners, such as bolts 38 and nuts 39.

Figure 9:
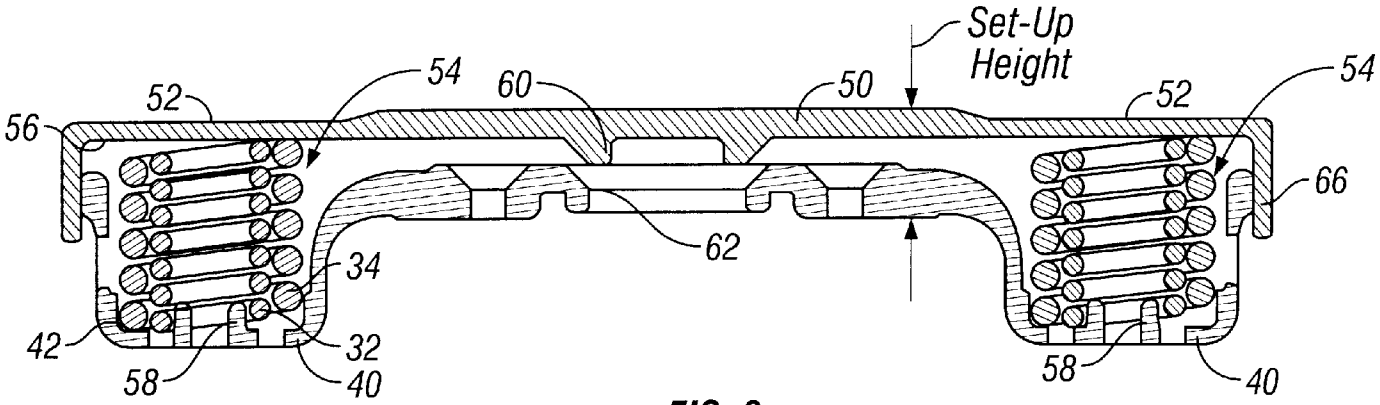
FIG. 9 is a cross-sectional view along line 9—9 of FIG. 8, showing the constant contact side bearing at its setup height.
Figure 10:
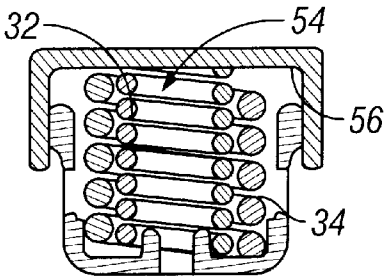
FIG. 10 is a cross-sectional view along section 10—10 of FIG. 8, showing the constant contact side bearing at its setup height.

The base member 28 also has end portions 40 which extend beyond the bolster 18, generally perpendicular to the longitudinal axis 24 of the bolster 18 and parallel to the longitudinal axis 25 of the car when the truck 10 and the car are oriented for rolling along a straight track. End portions 40 of base member 18 extend both outwardly beyond the edges of the bolster 18 and downwardly beyond top of the bolster 18. Each end portion 40 is generally cup-shaped and includes a lower, inner surface 42 (See FIG. 9) positioned below the top surface of bolster 18. The lower, inner surfaces 42 support the lower ends of the springs 32, 34, as will be described more fully hereinafter.

Figure 6:
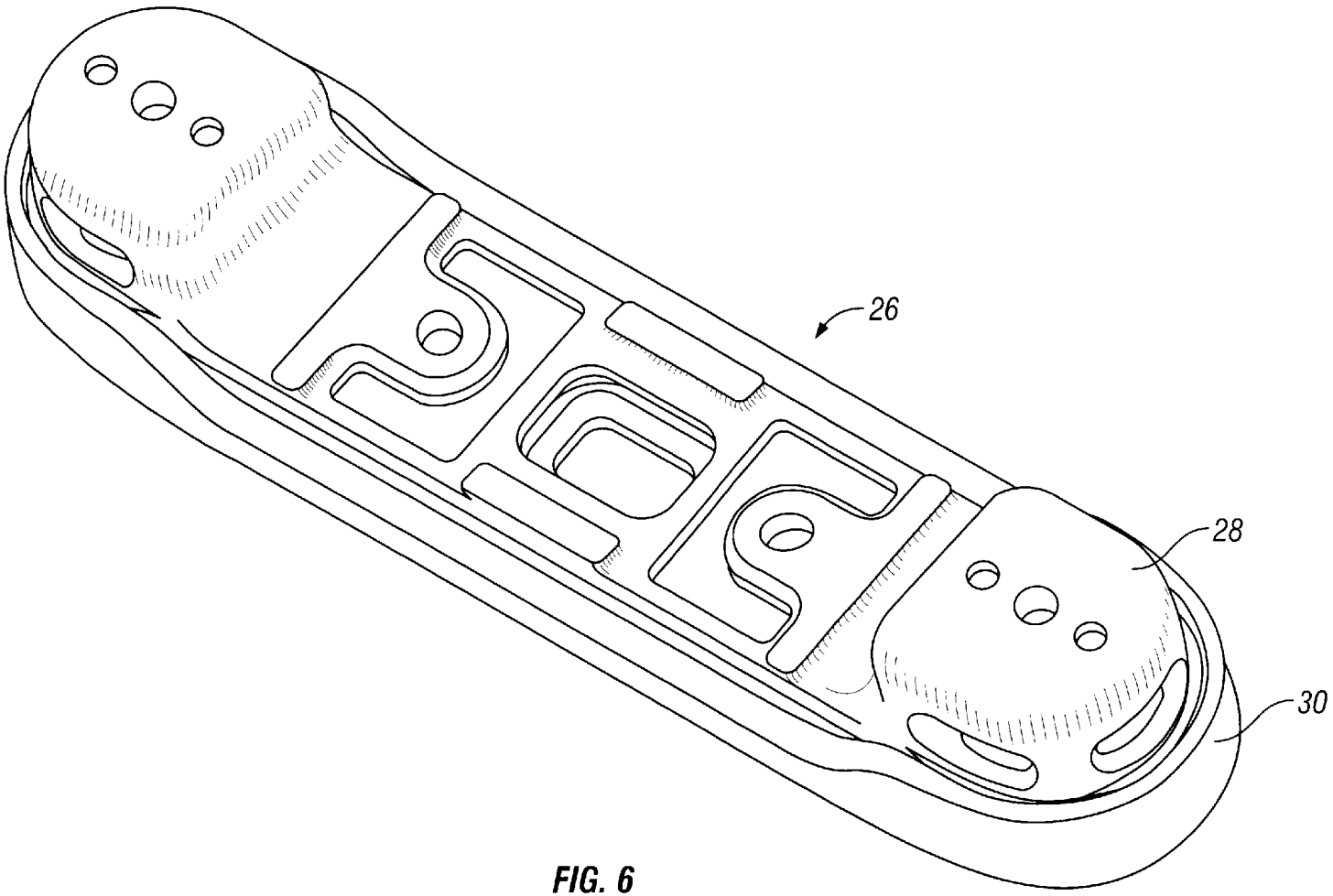
FIG. 6 is a bottom perspective view of the constant contact side bearing.
Figure 7:
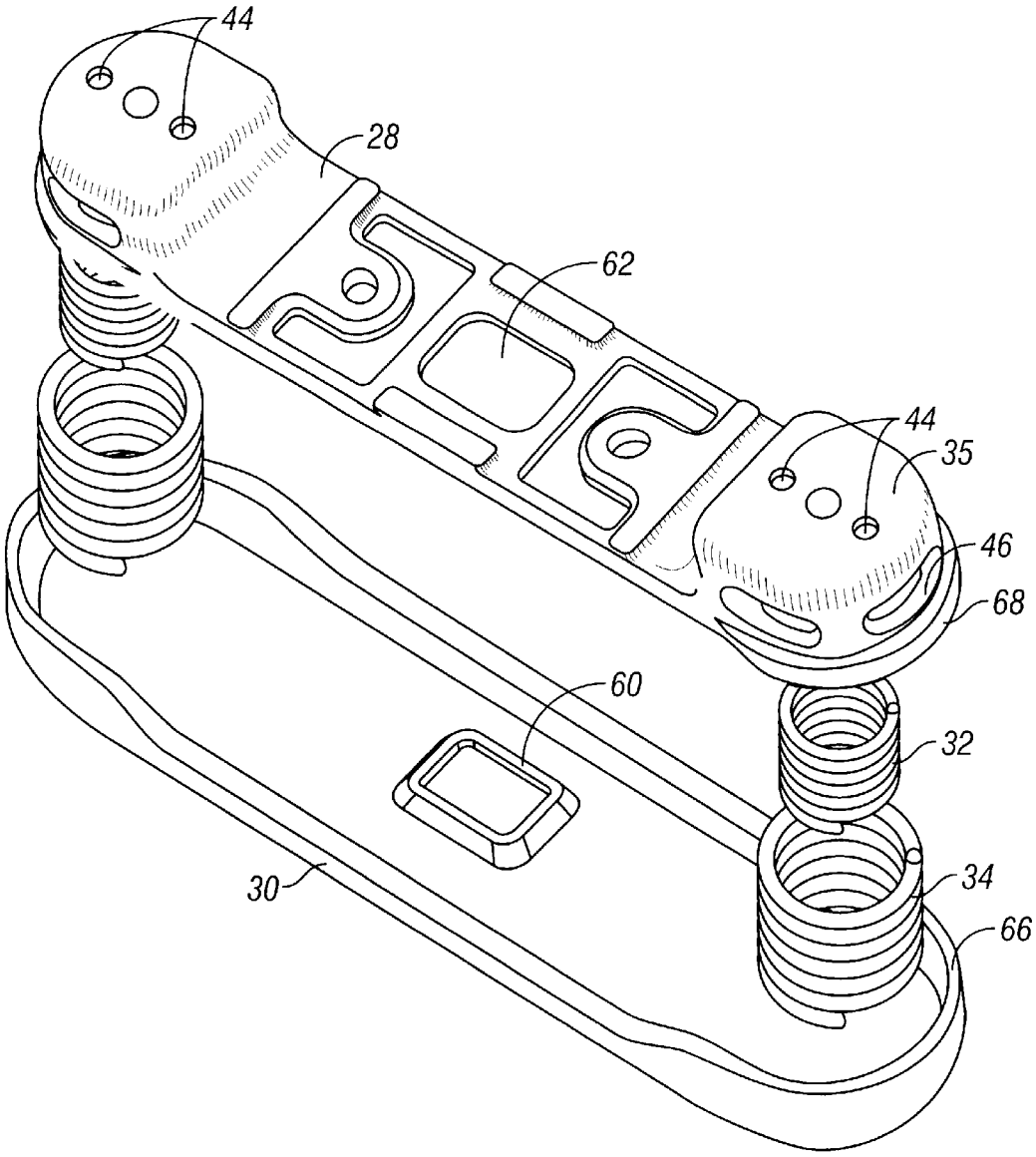
FIG. 7 is an exploded view of FIG. 6.
Figure 8:
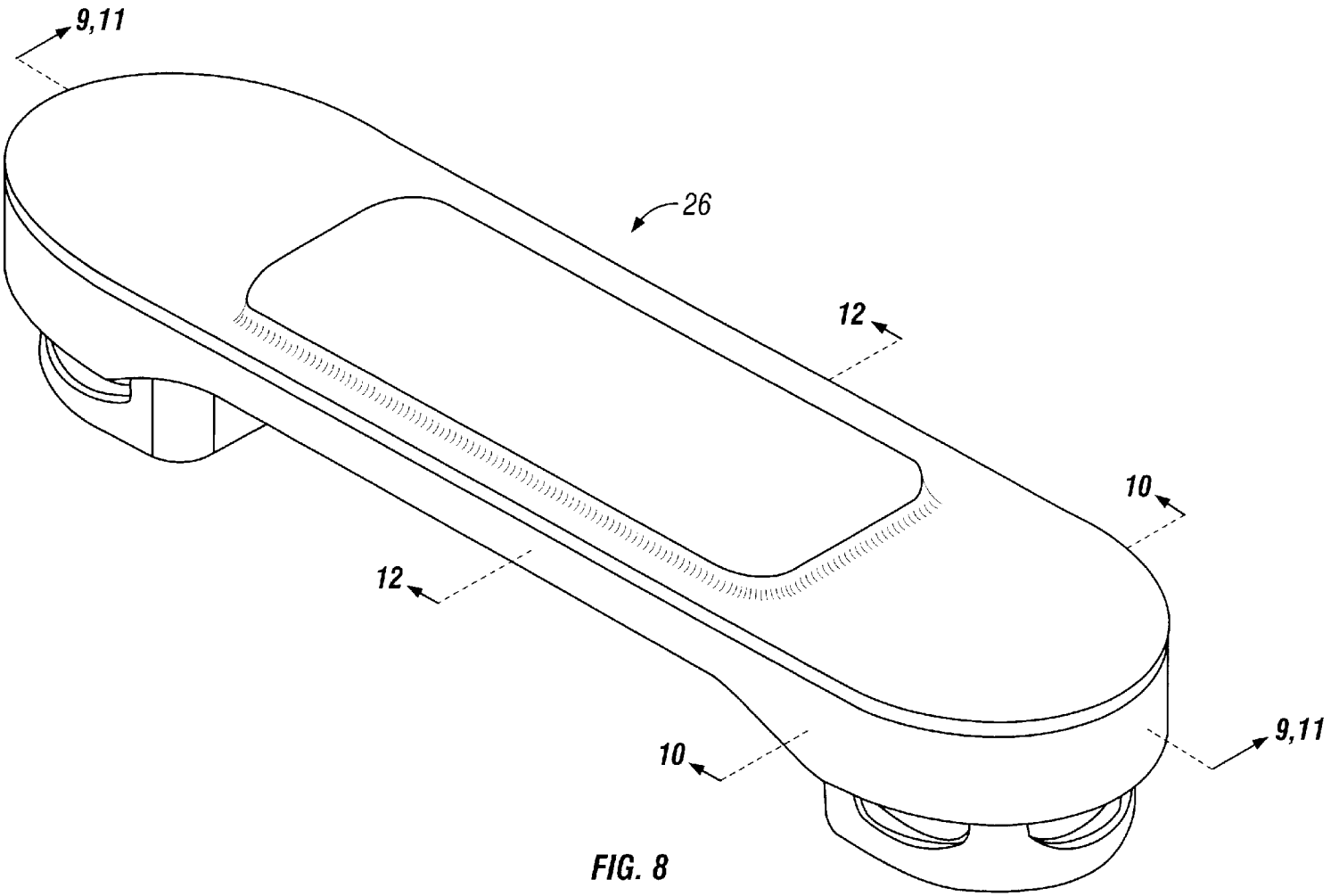
FIG. 8 is a top perspective view of the constant contact side bearing.

The end portions 40 may include drain openings 44 (see FIG. 6) in their bottom walls for draining water from the side bearing 26. The end portions 40 may also include inspection windows 46 in their side walls to allow inspection of the springs 34 without requiring the side bearing 26 to be disassembled. The inspection windows 46 also provide the added benefit of reducing the overall weight of the side bearing 26.

The top portion 30 is generally cap-shaped and is configured to mount on the top of the base portion 28. The top portion 30 includes a central portion 50 defining a wear pad 51 that is in constant contact with the wear plate 59 of the car body. The top portion 30 further includes end portions 52 that overly the base member end portions 40.

The base member and top member end portions 40, 52 define spring pockets 54 that accommodate the springs 32, 34. (See FIGS. 9–12). In the illustrated embodiment, each pocket supports an inner spring 32 and an outer spring 34. The springs 32, 34 are generally coaxial with one another and are compressed between the lower surface 42 of the base member end portions 40 and upper, inner surface 56 of the top member end portions 52. The spring pockets 54 include features for positioning the springs 32, 34 within the pockets. In the illustrated embodiment, the features include upwardly extending annular flanges 58 formed in the lower surfaces 42 of the base member end portions 40. The flanges 58 are sized to fit within the central opening of the inner springs 32, so as to position the inner springs within the pockets 54.

Using multiple springs in each pocket 54 is advantageous because it allows the desired forces to be achieved with a relatively short set-up height, e.g., on the order of 2¾ (2.75) inches or less. The set-up height is measured between the bottom face of the car body wear plate 59 and the top surface 41 of the side bearing pad of the truck bolster 18. (See generally FIGS. 3B and 9). The central portions 35, 50 of the base and top members 28, 30 have a reduced height in comparison to height of the end portions 40, 52. The combined height of the central portions 35, 50 is sized to match the desired set-up height. In this respect, one embodiment of the side bearing 26 is configured to provide 6000 lbs of force at a set-up height of 2⅜ (2.375) inches. By contrast, in this embodiment, the combined height of the end portions 40, 52 may be on the order of 5.26 inches.

Figure 11:
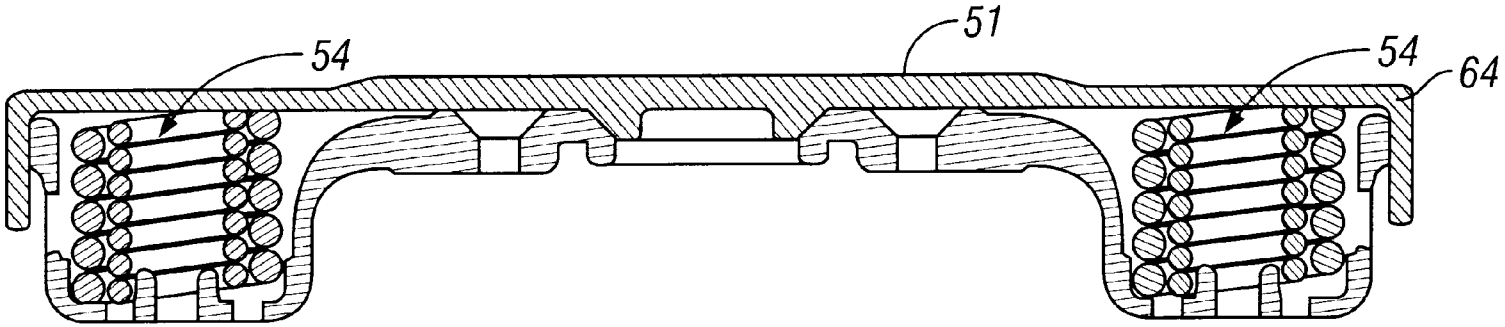
FIG. 11 is a cross-sectional view along section 11—11 of FIG. 8, showing the constant contact side bearing at its fully compressed (solid) Position.
Figure 12:
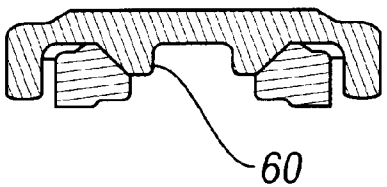
FIG. 12 is a cross-sectional view along section 12—12 of FIG. 8, showing the constant contact side bearing at its fully compressed (solid) position.

When the side bearing 26 is installed on the railway car, the springs 32, 34 support the top member 30 for vertical movement relative to the base member 28 between an upper position, corresponding to the set-up height (see FIGS. 9 and 10), and a lower (or solid) position (see FIGS. 11 and 12). According to one embodiment, the components of the side bearing 26 are configured to provide up to ⅝ (0.625) inches of vertical travel of the top member 30 relative to the base member 28, with a set-up height of 2⅜ (2.375) inches.

Means are provided for aligning the base and top members 28, 30, limiting downward travel of the top member relative to the base member, and for restricting relative horizontal movement, e.g. rotation, lateral displacement and longitudinal displacement, between these components when the side bearing is installed on the rail car. The means may include a post formed on the central portion either the top member 30 or the base member 28. In the illustrated embodiment, a downwardly extending post 60 is formed on the central portion 50 of the top member 30. The post 60 is positioned to mate with a reciprocal aperture 62 in the central portion 35 of the base member 28. While one post and aperture are shown, it will be appreciated that more than one post/aperture interface may be provided. The post 60 and aperture 62 are tapered, such that the interface between the post and aperture functions to align the top member 30 with the base member 28 as the base member moves downwardly relative to the base member. The tapered interface between the post 60 and aperture 62 also functions to restrict horizontal and vertical movement between the top member and the base member and to serve as a path for transmitting forces/loads (lateral, longitudinal and vertical) between the top and base members 28, 30. (See FIGS. 11 and 12). The interface between the post 60 and the aperture 62 concentrates the force/load transfer at the center portions 35, 50 and away from the end portions 40, 52. When the side bearing 26 goes solid, as shown in FIGS. 11 and 12, the forces between the railway car body and the bolster, are transferred directly through the post 60. As can be seen in FIG. 11, when the side bearing 26 goes solid, a vertical clearance gap 64 exists between the base and top member end portion 40, 52, thereby reducing forces/loads on the unsupported end portions 40, 52 of the side bearing 26. As a result, thinner material can be used to form the base and top members 28, 30, thereby reducing the overall weight and set-up height of the side bearing 26.

The top member 30 includes a downwardly extending side wall 66 which is sized to extend around the perimeter of the base member 28. The side wall forms a close, free-sliding fit with the outer periphery of the base portion 28. In the illustrated embodiment, the base member 28 includes arcuate ribs or flanges 68 that extend from the end portions 40. The arcuate flanges 68 fit within the arcuate ends of the side walls 66 and function to align the top member 30 and the base member 28 and to restrict relative horizontal movement between the top and the base members. The arcuate flanges 68 may be hardened, e.g. by flame hardening to improve their wear characteristics. During assembly of the side bearing 26, the side wall 66 functions to align the top member 30 with the base member 28. The side bearing 26 is configured such to provide a small clearance between the side wall 66 and the arcuate flanges 68 when the side bearing goes solid. (See FIG. 11). In the illustrated embodiment, this clearance is on the order of 0.02 inches. This clearance reduces stresses on the end portions 40, 52 when the side bearing 26 goes solid.

While the invention has been described with reference to a preferred embodiment, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A constant contact side bearing for use with a railway car body having a fore and aft longitudinal axis and a wear plate laterally spaced from the longitudinal axis, and with a railway truck including a bolster having a longitudinal bolster axis which is generally perpendicular to the longitudinal axis of the car body when the body and truck are oriented for straight-ahead rolling movement, the constant contact side bearing comprising:

a base member having a center portion mounted on top of the bolster and end portions extending downwardly and outwardly fore and aft beyond the bolster;

a top member overlaying and spaced above the base member and having a central portion including a wear pad positioned for constant contact with the body wear plate, the top member also having end portions that overlay the base member end portions, the base and top member end portions cooperating to form a pocket at each end of the base and top members;

at least one resilient device positioned in each of the pockets, the resilient devices being configured such that the side bearing provides a predetermined load between the body wear plate and the truck bolster at a predetermined set-up height as measured between the body wear plate and the truck bolster; and the central portion of at least one of the top and bottom members having a feature for limiting the relative rotation and vertical displacement of the base and top members relative to one another, a post formed on one of the top member and the base member, the post being configured to mate with a reciprocal aperture formed on the other member, wherein the post is tapered so as to guide the post into the aperture as the top member moves downwardly relative to the base, thereby aligning the top and bottom members.

2. The constant contact side bearing of claim 1, wherein the post comprises a downwardly extending post formed on the central portion of the top member.

3. The constant contact side bearing of claim 1, wherein the post is configured to limit the downward vertical displacement of the top member relative to the base sufficiently to prevent the end portions of the top from engaging with the end portions of the base during downward vertical displacement of the top relative to the base.

4. The constant contact side bearing of claim 1, wherein the resilient devices comprise metallic springs.

5. The constant contact side bearing of claim 1, wherein a pair of concentrically mounted springs are positioned in each of the pockets.

6. The constant contact side bearing of claim 5, wherein the base surface further defines features for positioning the springs within the pockets.

7. The constant contact side bearing of claim 1, wherein the central portions of the top and bottom members are sized so that the side bearing has a set-up height on the order of 2.75 inches or less.

8. The constant contact side bearing of claim 7, wherein the side bearing has a set-up height on the order of 2.375 inches.

9. The constant contact side bearing of claim 1, wherein the top member, bottom member, and resilient devices are configured to provide up to 0.625 inches of vertical displacement of the top member relative to the base member.

10. A reduced height side bearing for providing constant contact between a railway car body, a wear plate, a railway truck bolster, the constant contact side bearing being constructed to produce a predetermined load between the car body and the truck bolster at a predetermined set-up height as measured between the body wear plate and the truck bolster, the constant contact side bearing comprising:

a base member having a central portion mounted on top of the bolster, and pockets flanking the bolster;

a top member mounted on the base member for vertical movement relative thereto, the top member having a central portion defining a wear pad that is in constant contact with the body wear plate and end portions that overlay the pockets, the central portions of the base and top members being sized so that the side bearing has a set-up height on the order of 2.75 inches or less; and resilient devices positioned in each of the pockets for urging the top member upwardly relative to the base member, a post formed on one of the top member and the base member, the post being configured to mate with a reciprocal aperture formed on the other member, and wherein the post is tapered so as to guide the post into the aperture as the top member moves downwardly relative to the base, thereby aligning the top and bottom members.

11. The constant contact side bearing of claim 10, wherein the central portions of the base and top members are sized so that the side bearing has a set-up height on the order of 2.375 inches.

12. The constant contact side bearing of claim 10, wherein the top member, bottom member, and resilient devices are configured to provide up to 0.625 inches of vertical displacement of the top member relative to the base.

13. The constant contact side bearing of claim 10, further including means for limiting rotation of the base and top member relative to one another.

14. The constant contact side bearing of claim 10, wherein the post is further configured to limit downward displacement of the top member relative to the base member.

15. The constant contact side bearing of claim 10, further comprising means for limiting downward displacement of the top member relative to the base member.

16. The constant contact side bearing of claim 15, wherein the means comprises a post formed on the central portion of one of the top member and the base member, the post being configured to mate with a reciprocal aperture formed on the central portion of the other member.

17. The constant contact side bearing of claim 10, further comprising means for aligning the top and bottom portions.

18. The constant contact side bearing of claim 17, wherein the means for aligning comprises a post formed on central portion of one of the top member and the base member, the post being configured to mate with a reciprocal aperture formed on the central portion of the other member.

19. The constant contact side bearing of claim 18, wherein the means for aligning further comprises a downwardly extending side wall formed on the top member, the side wall being configured to engage around a portion of the base member to align the top member with the base member during installation of the side bearing.

20. The constant contact side bearing of claim 10, wherein the resilient devices comprise metallic springs.

* * * * *